US007721468B1

(12) United States Patent
Johnson et al.

(10) Patent No.: US 7,721,468 B1
(45) Date of Patent: May 25, 2010

(54) TIGHTENING SHOE

(75) Inventors: Gregory G. Johnson, 7310 132nd St., Hugom, MN (US) 55035; Martin Dalgaard, Santa Monica, CA (US); Thor Fasterholdt, Topanga, CA (US)

(73) Assignee: Gregory G. Johnson, Hugo, MN (US)

( * ) Notice: Subject to any disclaimer, the term of this patent is extended or adjusted under 35 U.S.C. 154(b) by 1190 days.

(21) Appl. No.: 11/212,283

(22) Filed: Aug. 26, 2005

(51) Int. Cl.
*A43C 11/00* (2006.01)
*A43B 5/04* (2006.01)

(52) U.S. Cl. ..... 36/50.1; 36/118.1

(58) Field of Classification Search ..... 36/50.1, 36/50.5, 118.1, 118.2; 24/712.7
See application file for complete search history.

(56) References Cited

U.S. PATENT DOCUMENTS

| | | | | |
|---|---|---|---|---|
| 4,654,985 A | | 4/1987 | Chalmers | 36/50 |
| 4,724,626 A | | 2/1988 | Baggio | 36/117 |
| 4,741,115 A | | 5/1988 | Pozzobon | 36/117 |
| 4,811,503 A | | 3/1989 | Iwama | 36/119 |
| 4,942,680 A | | 7/1990 | Benetti | 36/119 |
| 5,205,055 A | | 4/1993 | Harrell | 36/50.001 |
| 5,259,094 A | | 11/1993 | Zepeda | 24/712 |
| 5,335,401 A | * | 8/1994 | Hanson | 24/712.5 |
| 5,839,210 A | | 11/1998 | Bernier et al. | 36/50.1 |
| 5,873,183 A | | 2/1999 | Posner | 36/50.1 |
| 5,934,599 A | * | 8/1999 | Hammerslag | 242/396.1 |
| 6,032,387 A | | 3/2000 | Johnson | 36/50.1 |
| 6,128,835 A | | 10/2000 | Ritter et al. | 36/45 |
| 6,378,230 B1 | * | 4/2002 | Rotem et al. | 36/50.1 |
| 6,467,194 B1 | | 10/2002 | Johnson | 36/50.1 |
| 6,877,256 B2 | * | 4/2005 | Martin et al. | 36/50.5 |
| 6,896,128 B1 | | 5/2005 | Johnson | 206/50.1 |
| 6,922,917 B2 | * | 8/2005 | Kerns et al. | 36/50.1 |
| 2003/0150135 A1 | | 8/2003 | Liu | 36/50.1 |

* cited by examiner

*Primary Examiner*—Jila M Mohandesi
(74) *Attorney, Agent, or Firm*—Moss & Barnett

(57) ABSTRACT

A tightening shoe is provided with a sole, an upper and crisscrossing laces. The lace ends project into the shoe structure where they are received by a tightening mechanism. The tightening mechanism includes a winding gear for winding the lace ends about its perimeter to withdraw the laces into the tightening mechanism's interior chamber. In addition, the tightening mechanism includes a drive gear which is rotated by a pre-wound tightening cable which is positioned immediately adjacent to the winding gear. Preferably, the winding gear and drive gear are positioned within the shoe's sole so as to rotate about a vertical axis relative to the shoe's structure.

6 Claims, 8 Drawing Sheets

TIGHTENING SHOE

BACKGROUND OF THE INVENTION

The present invention relates to a shoe and, more particularly, to a tightening shoe.

Footwear generally comprises a sole and an upper attached to the sole which surrounds the foot. Typically, the upper is removably and adjustably secured to the foot with lacing, which generally crisscrosses back and forth between eyelets formed in the lateral and medial sides of the upper. As the lace ends are pulled, the shoe is tightened as the eyelets and hence the medial and lateral sides of the upper are pulled together. The laces are then tied together with a knot commonly referred to as a "bow". Unfortunately, tying a bow is time consuming, and difficult for small children and persons having difficulties with their fine motor capabilities.

Shoes which incorporate a mechanized tightening system in order to eliminate the need to tie a bow are known in the prior art. However, none of the mechanized tightening systems heretofore devised has been entirely successful or satisfactory. Major shortcomings of the tightening systems of the prior art are that they fail to tighten the shoe from both sides so that it conforms snugly to the wearer's foot, and that they lack any provision for quickly loosening the shoe when it is desired to remove the shoe from the wearer's foot. Aspects of prior art tightening systems contributing to their lack of success and satisfaction have been (1) complexity, in that they involve numerous parts; (2) the inclusion of expensive parts, such as small electric motors; (3) the use of parts needing periodic replacement, e.g. a battery; and (4) the presence of parts requiring frequent maintenance. These aspects, as well as others not specifically mentioned, indicate that considerable improvement has been needed in order to attain a tightening shoe that is completely successful and satisfactory.

Recently, several tightening mechanisms have been developed which are disclosed in U.S. Pat. Nos. 6,032,387; 6,467,194 and 6,896,128 naming Johnson as the inventor which are incorporated in their entirety by reference herein. Each of these patents describe shoes which include tightening mechanisms which draw the lace ends into a chamber formed in the shoes sole in order to tighten the laces of the shoe. The constructions are extremely satisfactory, and a significant advance over prior tightening shoes. Unfortunately, the tightening and loosening mechanisms are still relatively complicated, requiring a large number of parts. Furthermore, the various tightening mechanisms required significant space within the shoe's sole.

It would therefore be desirable to provide a tightening shoe that tightened around a person's foot quickly and easily without requiring that a person tie a knot in the shoe laces.

It would also be desirable to provide a tightening shoe that incorporated a tightening mechanism which was lighter and required less parts than prior tightening mechanisms.

Furthermore, it would be desirable to provide a shoe that incorporated a tightening mechanism that required less space and was less expensive to manufacture than prior tightening mechanisms.

SUMMARY OF THE INVENTION

Briefly, in accordance with the invention, I provide an improved tightening and loosening shoe. The shoe may be any type of shoe such as a dress shoe. However, preferably the tightening shoe is a sport or athletic shoe which tightens snugly about the wearer's foot and has an automated loosening capability.

The tightening shoe includes the traditional components of a shoe including a sole, an upper, and a front and back commonly referred to as a toe and heel. In addition, the tightening shoe may or may not include a tongue depending on the shoe's style.

The upper is split into left and right sides and has an opening in the middle where the tongue is traditionally positioned. Moreover, the upper includes any number of pairs of lace eyelets or anchor button holes for receiving one or more laces which pass through the lace eyelets in a traditional crisscross pattern over the shoe's tongue. The laces are laced through the eyelets in a traditional configuration such that pulling on the lace ends causes the upper sides to come together across the tongue to tighten the shoe.

In addition to the aforementioned traditional shoe structure, the tightening shoe of the present invention includes a tightening mechanism for tightening and loosening the shoe's laces. The tightening mechanism includes a chamber which is preferably located in the shoes' sole so as to remain effectively hidden to the outside viewer. However, the chamber can also be located within the shoe upper or even within a housing integrated into the rear of the shoe, or even mounted to the rear of the shoe. The tightening mechanism further includes a winding gear having a cylindrical body which rotates about a central axis. Preferably, though not necessarily, the winding gear is positioned such that its central axis is substantially vertical with respect to the shoe's orientation. The shoe's laces are affixed to the winding gear such that rotation of the winding gear in a tightening direction causes the laces to wind about the winding gear to withdraw the laces into the shoes' interior chamber and thereby tighten the laces of the shoe.

The tightening mechanism further includes a drive gear positioned adjacent to the winding gear and rotating about the winding gear's central axis. Both the drive gear and the winding gear include engaging and correspondingly aligned directional ratcheting teeth positioned so that rotation of the driving gear in the tightening direction causes the drive gear teeth to engage the corresponding winding gear teeth to cause the winding gear to rotate in the tightening direction.

The tightening mechanism of the present invention further includes a biasing means, preferably in the form of a coil spring for rotatably biasing the drive gear in the loosening direction. In addition, the tightening mechanism includes a tightening cable partially wound about the perimeter of the drive gear. The tightening cable extends out of the housing interior's chamber through the upper to extend from the upper heel portion of the shoe. Exterior to the shoe upper, the tightening cable includes a pull tab which can be configured in various forms to allow a person to easily pull the tightening cable. Pulling on the cable and withdrawal of the tightening cable through the upper causes the drive gear to rotate in the tightening direction. As a result of the drive gear teeth engaging the winding gear teeth, rotation of the drive gear causes the winding gear to rotate to withdraw and tighten the shoe's laces.

In addition to the first pair of ratcheting directional teeth, the tightening mechanism includes a second set of directional ratcheting teeth positioned to prevent the winding gear from rotating in the loosening direction when the drive gear is not caused to rotate in the tightening direction. Preferably, the second pair of directional ratcheting teeth include ratcheting teeth which project from the housing to engage ratcheting teeth which project from the winding gear. These ratcheting teeth are oriented so that rotation of the winding gear in the tightening direction is not impeded, but rotation of the winding gear in the loosening direction is impeded by engagement of respective sets of ratcheting teeth.

In operation, pulling the tightening cord causes rotation of the drive gear which, in turn, causes rotation of the winding gear and the resulting withdrawal and tightening of the shoe laces. To loosen the shoe laces, both pairs of directional ratcheting teeth are caused to disengage. Disengagement of the ratcheting teeth can be accomplished by various constructions known to those skilled in the art. However, in a preferred embodiment, the drive gear and winding gear are moveable in the axial direction such that the drive gear can be moved axially with respect to the winding gear to cause the ratcheting teeth between respective gears to disengage. Similarly, the winding gear is capable of axial movement away from the teeth projecting from the housing to permit rotation of the winding gear in the loosening direction by a person simply pulling on the shoe laces exterior to the shoe's upper.

In a preferred embodiment, the tightening mechanism includes a biasing means in the form of a compression spring which forces the drive gear against the winding gear, which in turn forces the winding gear against the housing to maintain engagement of each pair of ratcheting teeth.

In addition, preferably the tightening mechanism includes a coil spring which biases the tightening gear in the loosening direction so as to cause the tightening cable to wind about the tightening gear when the tightening cable is not being pulled upon by the shoe's user.

It is thus an object of the present invention to provide a simple, inexpensive and easy to use tightening shoe.

It is an additional object of the present invention to provide a tightening shoe which requires less mechanical parts than previous designs.

It is also an object of the present invention to provide a tightening shoe which provides the appearance of a conventional shoe.

Moreover, it is an object of the present invention to provide a tightening shoe which includes a tightening mechanism which can be placed at various locations within a shoe structure, but preferably can be located within the shoe's sole.

These and other and more specific objects and advantages of the invention will be apparent to those skilled in the art from the following detailed description taken in conjunction with the drawings.

DETAILED DESCRIPTION OF THE INVENTION

Figure 1:
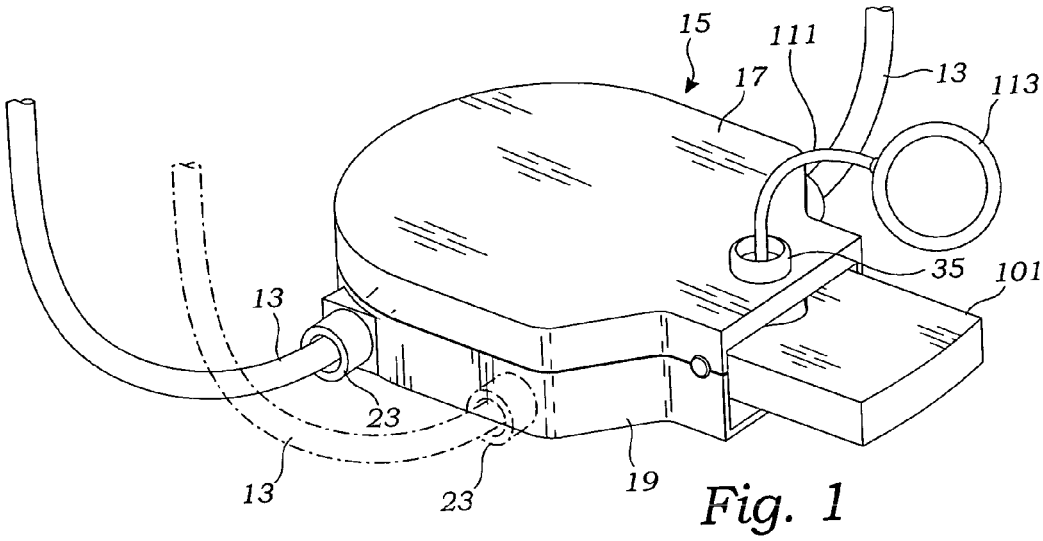
FIG. 1 is a perspective view illustrating the tightening mechanism of the present invention.
Figure 2:
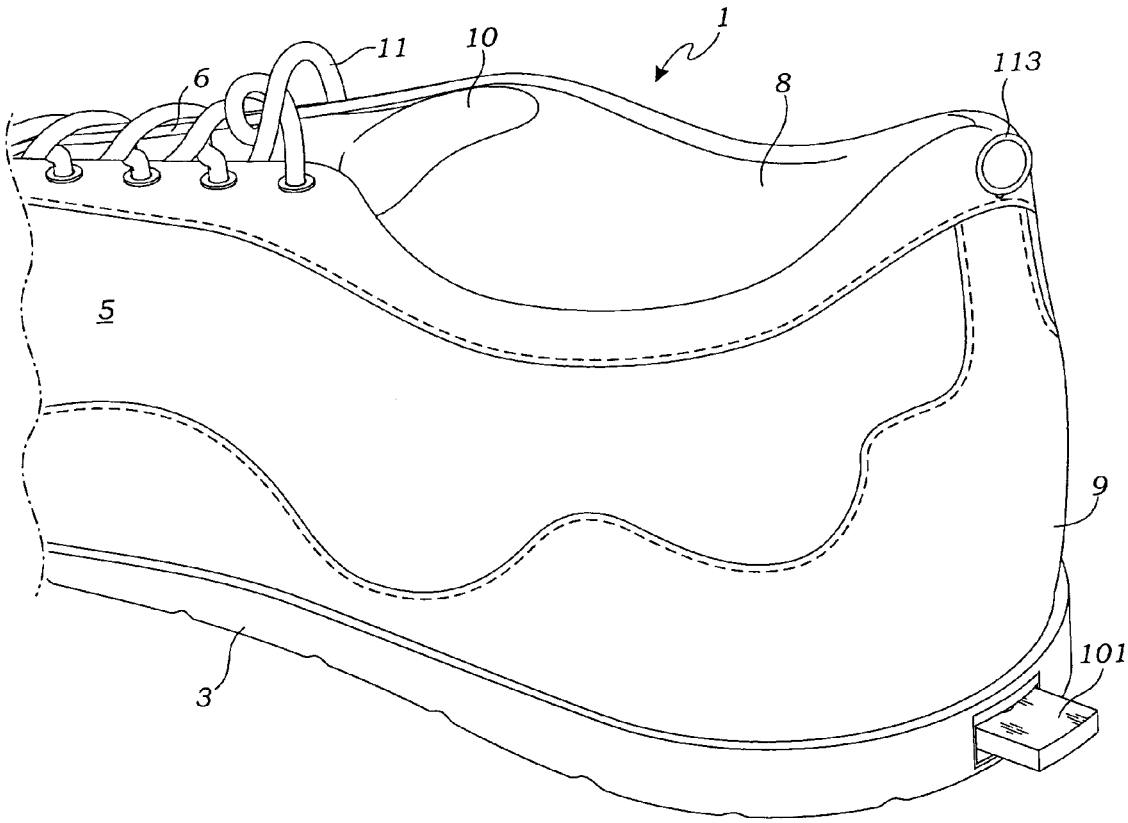
FIG. 2 is a perspective view illustrating the tightening shoe of the present invention including lever arm projecting from the shoe's heel.

While the present invention is susceptible of embodiment in various forms, as shown in the drawings, hereinafter will be described the presently preferred embodiment of the invention with the understanding that the present disclosure is to be considered an exemplification of the invention, and it is not intended to limit the invention to the specific embodiment illustrated.

Referring to FIGS. 2-6, the tightening shoe 1 of the present invention includes a traditional exterior structure including a sole 3, an upper 5, a toe 7 defining the front of the shoe, and a heel 9 defining the rear of the shoe. In addition, the shoe 1 includes an opening 8 for receipt of a person's foot, and may or may not include a tongue 10. The upper 5 is split down the top to form medial and lateral sides 6 which cover the tongue 10. In order to bring the upper's sides 6 together, the tightening shoe 1 includes several pairs of lace eyelets or button holes 14 for receipt of one or more laces 11. Preferably the tightening shoe includes only a single lace which is threaded through the lace eyelets 14 to form two ends. However, it is possible to provide a tightening shoe 1 with a plurality of laces, such as disclosed in the inventor's prior U.S. Pat. No. 6,467,194 which discloses a tightening shoe including two laces in which one end of each lace is affixed to the shoe upper. Because the preferred embodiment of the present invention includes a single lace, the present invention will be described with reference to each shoe including only a single lace, though a shoe including a plurality of laces is intended to be within the scope of the present invention.

Figure 3:
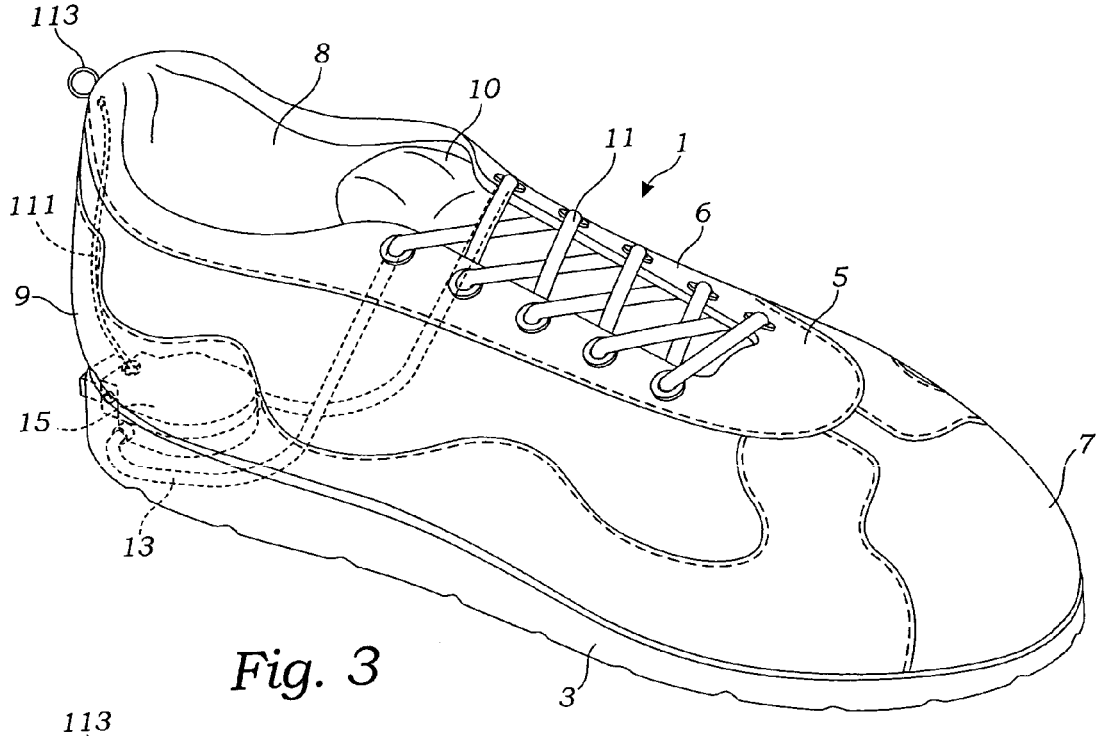
FIG. 3 is a perspective view illustrating the tightening shoe of the present invention including a first embodiment for routing the shoe laces.
Figure 4:
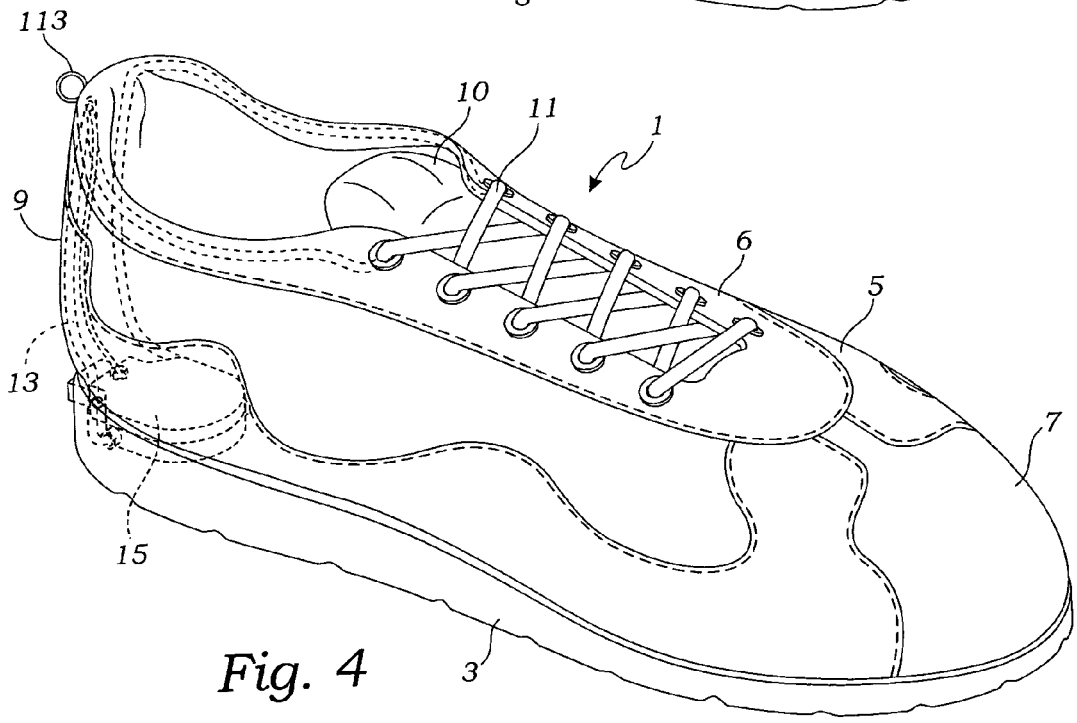
FIG. 4 is a perspective view illustrating the tightening shoe of the present invention including a second embodiment for routing the shoe's laces.
Figure 5:
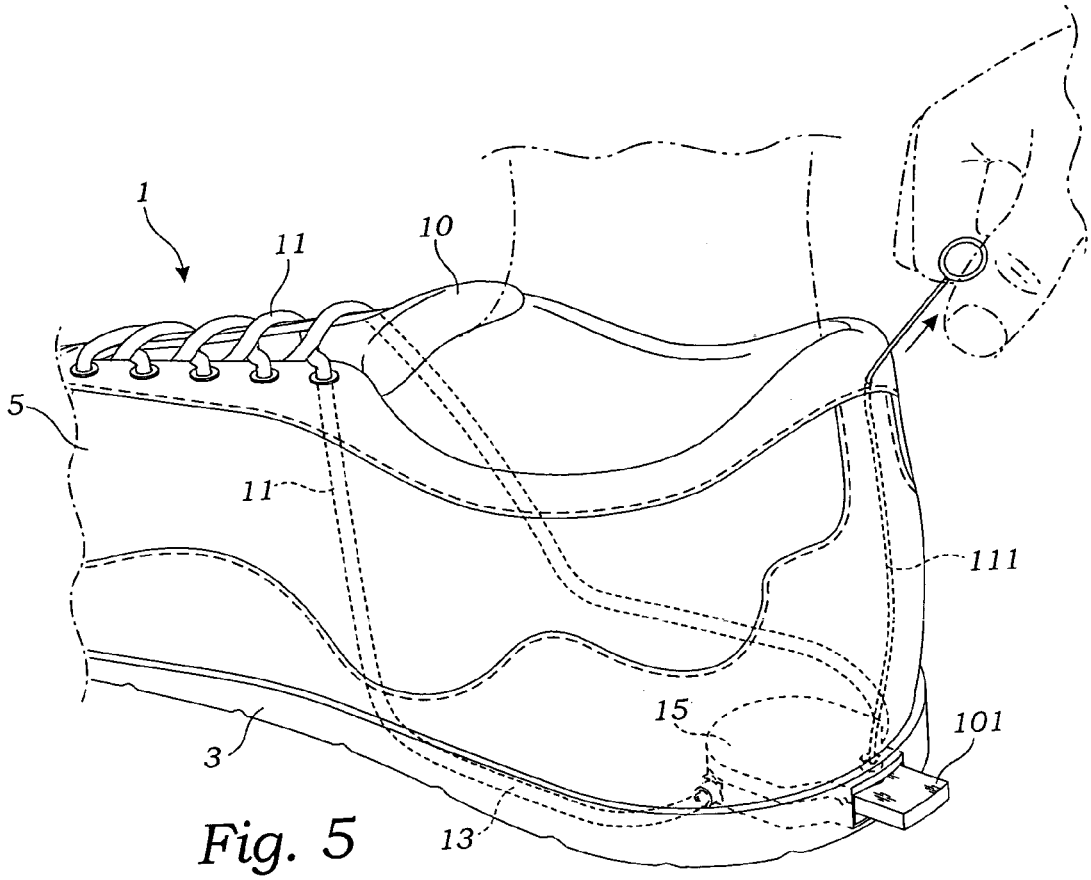
FIG. 5 is a rear perspective view illustrating the tightening shoe of the present invention in which a person is pulling the tightening cable.
Figure 6:
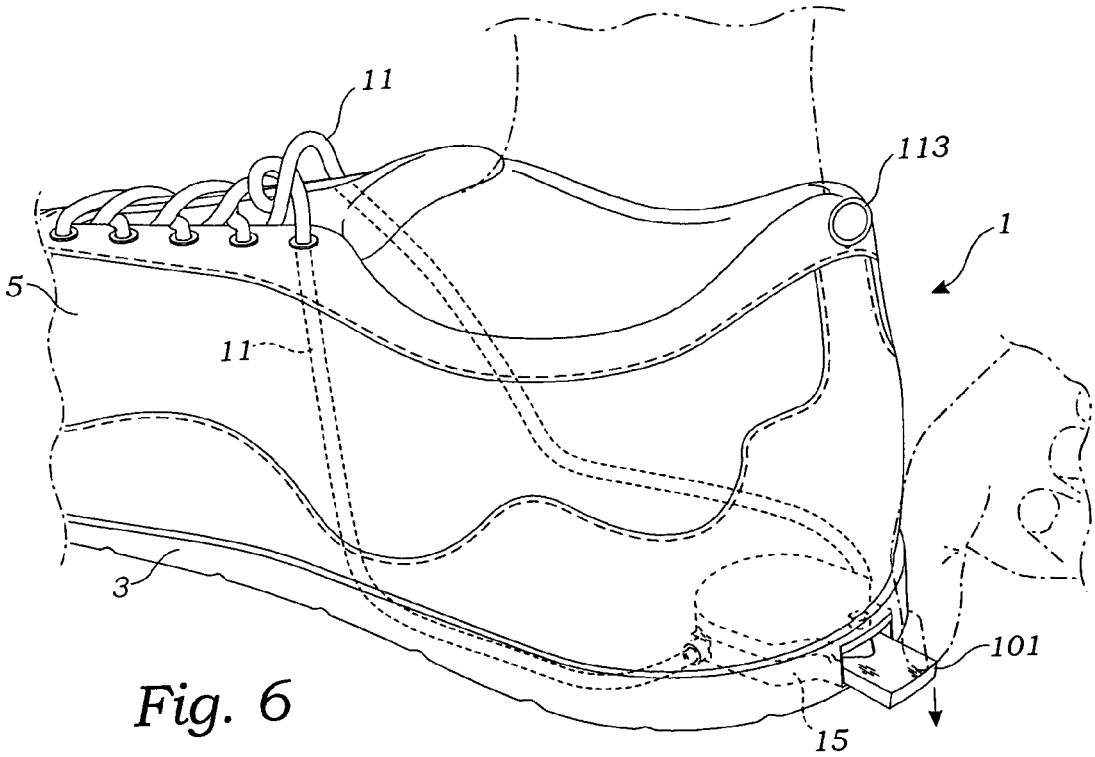
FIG. 6 is a rear perspective view illustrating the tightening shoe of the present invention illustrating a person pressing the releasing lever.

With reference to FIGS. 3-6, the lace 11 includes a pair of lace ends 13 which are routed through the shoe upper 5 in any of several different pathways to a tightening mechanism 15. For example, FIGS. 3, 5 and 6 illustrate a preferred embodiment of the invention in which the lace ends 13 are routed downwardly from the lace eyelets at the top of the tightening shoe to the sole 3. The laces then travel through the lace sole until passing into the tightening mechanism 15. Meanwhile, FIG. 4 illustrates a second preferred embodiment of the invention in which the laces 11 travel through the shoe upper 5, around the foot opening 8 until reaching the heel 9 of the shoe. The laces are then routed down through the rear face of the shoe until reaching the tightening mechanism 15. Preferably the laces travel through low friction conduits (not shown) from the lace eyelets 14 until reaching the tightening mechanism 15.

With reference to all of the Figures, the tightening mechanism 15 includes a housing 16 having an interior chamber 21. The housing can be prefabricated out of various materials, such as plastic, for insertion into the shoe's sole 3 or upper 5. Alternatively, the tightening shoe sole can be constructed with an interior chamber to form an integrated housing. Furthermore, the housing can be located at various locations within the tightening shoe, such as within the shoe's sole, (such as shown in the drawings), or within the rearward portion of the shoe's upper, or within a separate module attached to the rear of the shoe. With reference to FIGS. 3-6, the lace ends are routed into the tightening mechanism's interior chamber by passing through lace ports 23.

For manufacturing reasons, preferably the housing is manufactured in two parts including a top portion 17 and a bottom portion 19. For simplicity, the housing is described herein as having a top or bottom, but as would be understood by those skilled in the art, the housing can be reoriented in any number of configurations, and accordingly, the terms top and bottom are not intended to limit the invention. For reasons explained in greater detail below, the housing's bottom portion 19 preferably includes one or more directional ratcheting teeth 39 which project upwardly in a circular pattern from the housing's bottom portion.

The tightening mechanism 15 further includes a winding gear 61 to which the lace ends 13 are affixed. The winding gear may be constructed in various configurations. However, in a preferred embodiment the winding gear is a cylindrical structure having a perimeter and a circumferential recess 65 for receipt of the lace ends 13 as the winding gear is rotated. To enable the winding gear to rotate, the winding gear includes a center hole 77 through which a central axle 51 is positioned. The axle is positioned to engage and affix to the housing's top portion 17 and bottom portion 19 by having the axles' extremities project into recesses 31 formed in the top and bottom of the housing. In addition to rotatable movement around the axle 51, the winding gear is also capable of axial movement up and down within the housing interior chamber by sliding telescopically upon the axle 51. In a preferred embodiment, the winding gear includes an annularly shaped collet 71 which projects upwardly from the winding gear's upper surface. In addition, the collet includes a groove 73 for receipt of radially projecting ring 75.

Figure 7:
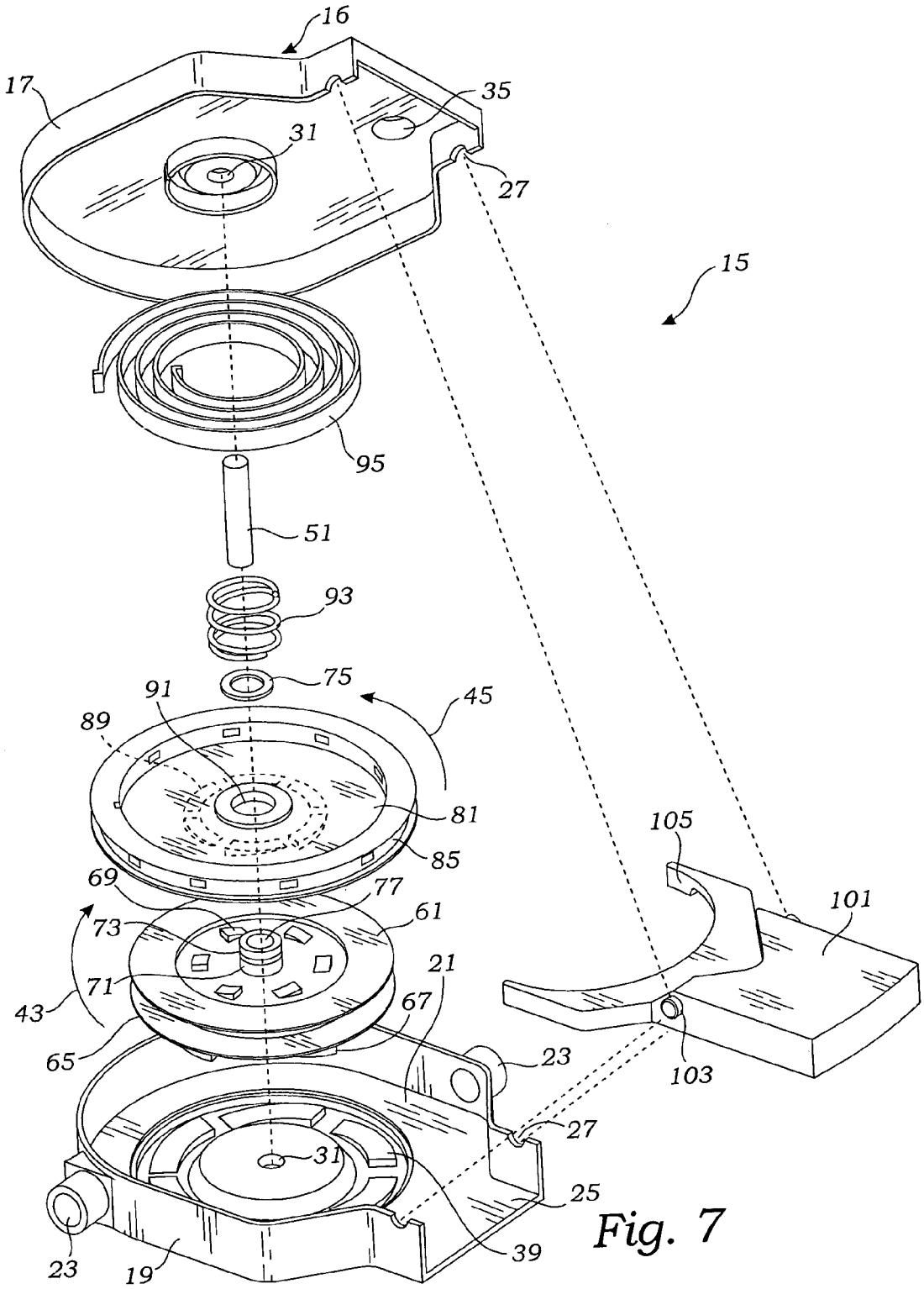
FIG. 7 is an exploded top view illustrating the tightening mechanism of the present invention.
Figure 8:
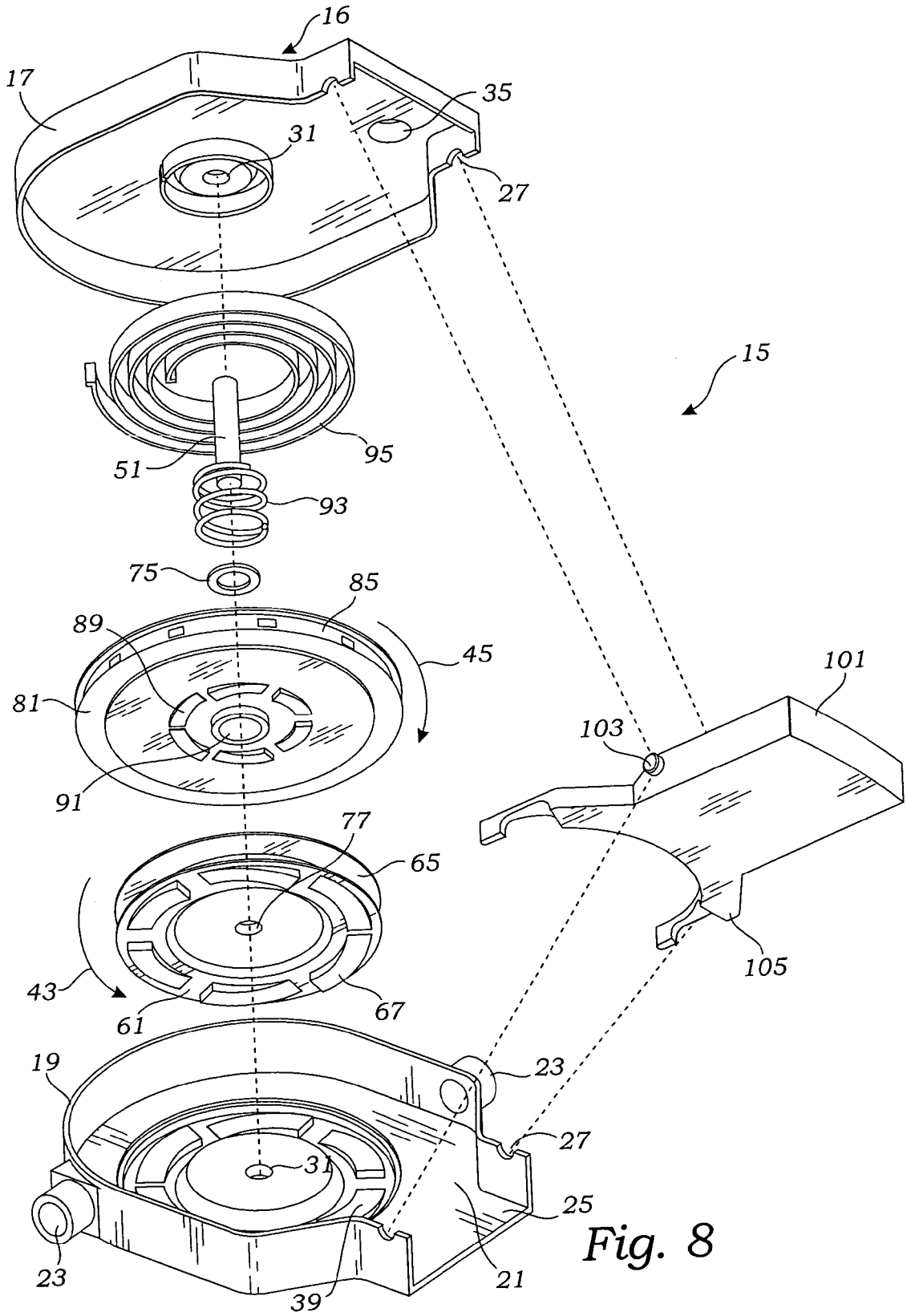
FIG. 8 is an exploded bottom view illustrating the tightening mechanism of the present invention.
Figure 9:
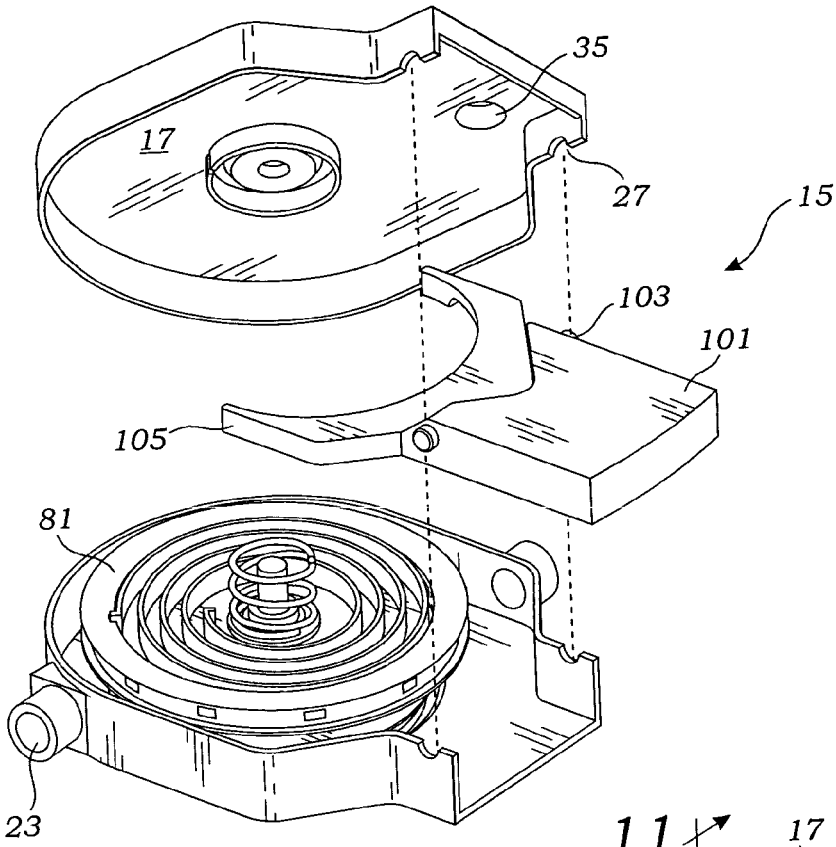
FIG. 9 is a partially exploded top view of the tightening mechanism of the present invention.
Figure 10:
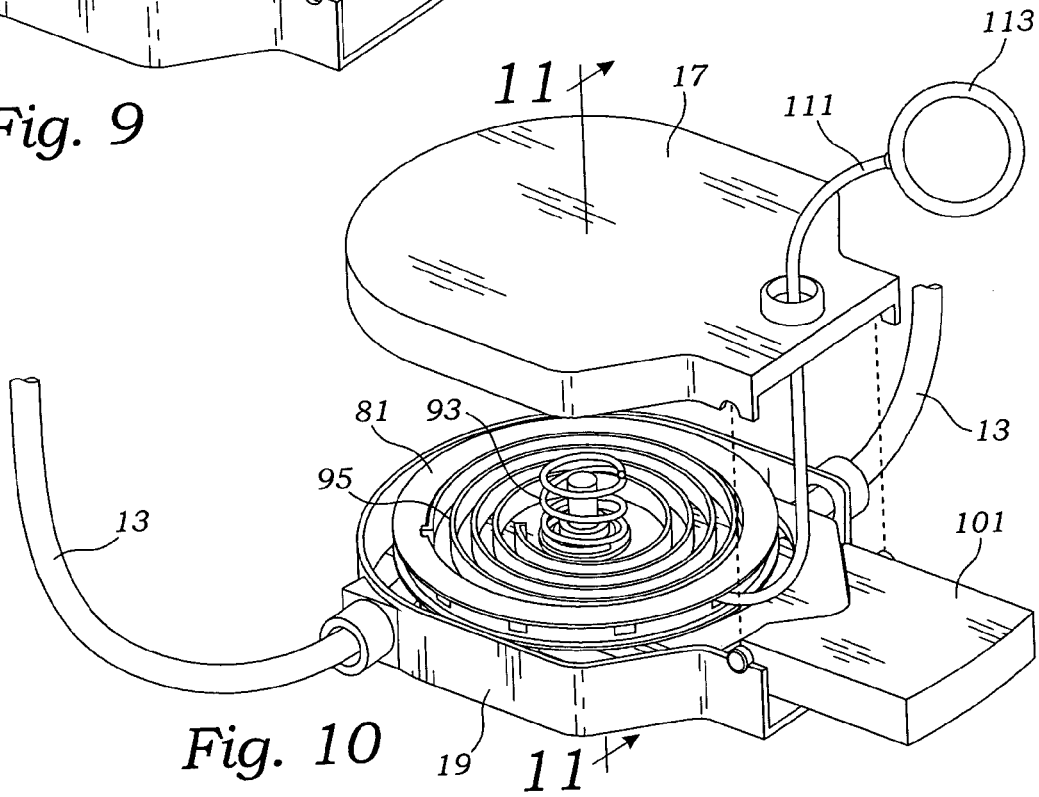
FIG. 10 is a partially exploded top view of the tightening mechanism of the present invention incorporating shoe laces and a tightening cable.

The winding gear 61 further includes first and second sets of directional ratcheting teeth. The first set of directional ratcheting teeth 67 are positioned on the winding gear's bottom side in a circular pattern to engage the housing's directional ratcheting teeth 39 as shown in FIGS. 7 and 8. The ratcheting teeth are configured to easily permit rotation of the winding gear in a tightening direction 43, but the respective ratcheting teeth include front abutments which impede rotation of the winding gear in a loosening direction 45. Meanwhile, the winding gear's second set of directional ratcheting teeth 69 are positioned in a circular pattern on the winding gear's upper surface.

In addition to the winding gear 61, a drive gear 81 is positioned within the tightening mechanism's interior chamber 21. The drive gear is rotatable about the axle's central axis and positioned to engage the upper surface of the winding gear 61. However, instead of engaging the axle 51, the drive gear includes a central hole 91 which is large enough to receive the winding gear's annular collet 71. In addition to radial movement about the collet 71, the drive gear is moveable up and down upon the collet until restricted by engagement of the drive gear into the winding gear or engagement of the drive gear into the ring 75.

The drive gear includes a set of ratcheting teeth 89 which are configured in a circular pattern to project downwardly from the drive gear's bottom surface to engage the winding gear's second set of directional ratcheting teeth 69. The drive gear teeth and second set of winding gear teeth are positioned and configured to permit rotation of the drive gear relative to the winding gear in the loosening direction 45, but impede rotation of the drive gear relative to the winding gear in the tightening direction 43 so that forceable rotation of the drive gear in the tightening direction 43 causes the winding gear to rotate correspondingly.

With reference to FIGS. 1 and 10-14, rotation of the drive gear 81 is accomplished by pulling upon a tightening cable 111 which travels through the shoe's upper and through a cable port 35 into the tightening mechanism housing 16 where it is partially wound about the drive gear's perimeter 83. Preferably, the drive gear also includes a circumferential recess 85 for receipt of the tightening cable as the drive gear is rotated.

The tightening mechanism of the present invention preferably includes two springs. A compression spring 93 is provided which engages the interior surface of the housing's top 17 at one end and engages the top surface of the drive gear 81 at its other end. The compression spring forces the drive gear into the winding gear, which in turn forces the winding gear into the housing's bottom portion 19. Moreover, the compression spring causes the respective pairs of ratcheting teeth to engage to impede rotation of the winding gear in the loosening direction 45 and impede rotation of the winding gear in the loosening direction relative to the drive gear. In addition to the compression spring, the tightening mechanism preferably includes a coil spring 95. The interior extremity of the coil spring engages the inner surface of the housing's top 17 while the exterior extremity of the coil spring engages the drive gear. The coil spring is configured to bias the drive gear in the loosening direction so as to withdraw the tightening cable into the housing's interior when the tightening cable is not being pulled.

In order to bias the drive gear and winding gear upwardly, as shown in FIGS. 5 and 6, the tightening mechanism includes a lever arm 101 which projects through the housing's output port 25 the shoe's exterior. The lever arm is pivotally attached to the housing pivot tabs 103 which are received within housing holes 27. In addition, the lever arm includes a pair of fingers 105 which project into the housing's interior chamber around the exterior of the winding gear to below the drive gear's perimeter. Depression of the exterior end of the lever arm 101 causes the lever arm to pivot causing the fingers 105 to move upwardly to engage the underside of the drive gear 81. Further depression of the lever arm 101 causes the drive gear to move upwardly until the drive gear's ratcheting teeth 89 disengage from the winding gear's second set of ratcheting teeth 69. Upon further depression, the drive gear engages the ring 75 which is affixed to the winding gear's collet 71. And still further depression of the lever arm 101 causes the drive gear to move upwardly to force the ring 75, collet 71 and the rest of the winding gear 61 to also move upwardly until the winding gear's first set of ratcheting teeth 67 disengage from the housing's ratcheting teeth 39 which allows the winding gear to spin freely.

Figure 11:
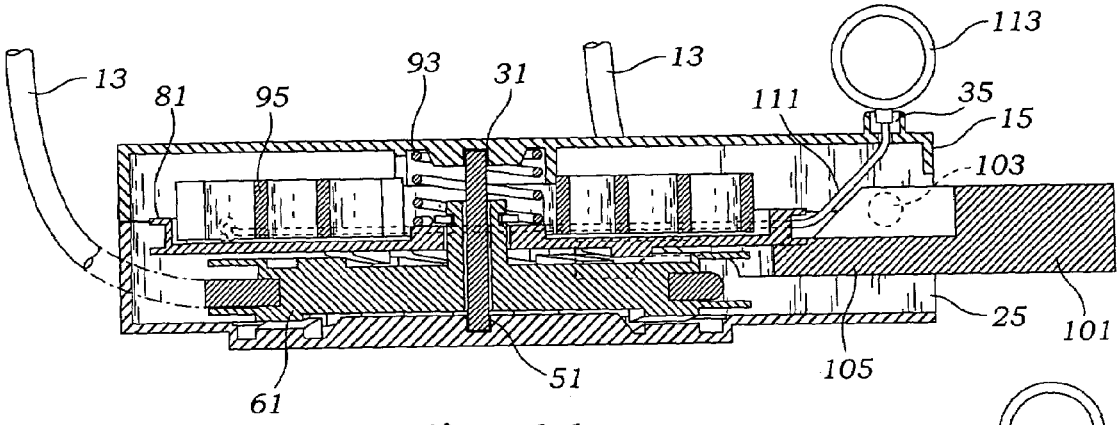
FIG. 11 is a side cut-away view of the tightening mechanism illustrated in FIG. 10 in which the tightening cable is partially wound about the drive gear of the present invention.
Figure 12:
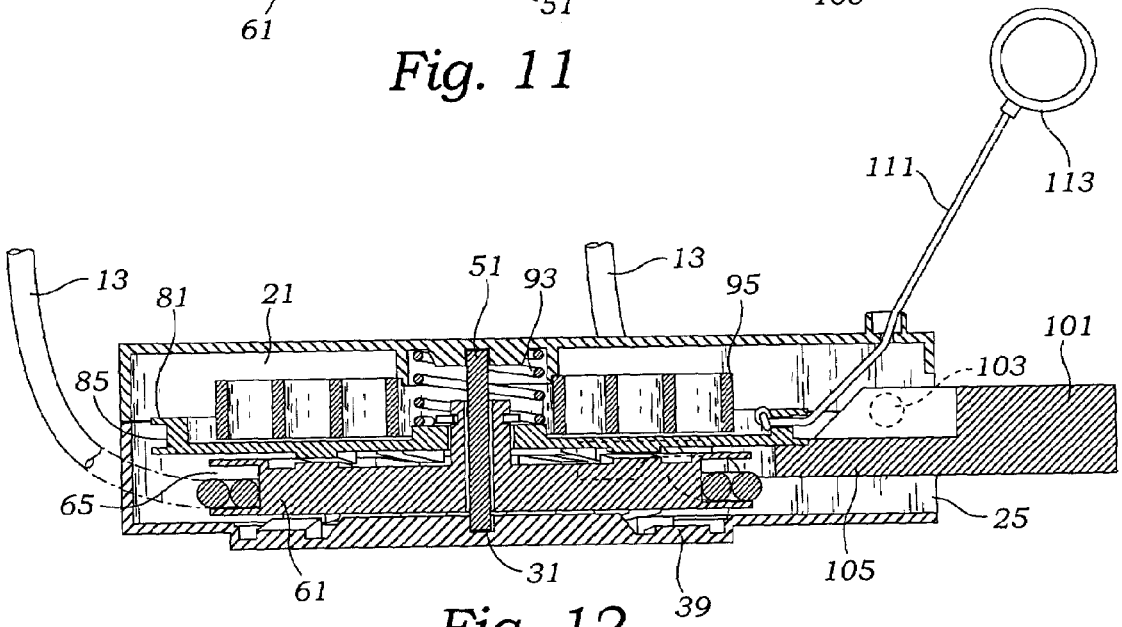
FIG. 12 is a side cut-away view illustrating the tightening mechanism shown in FIGS. 10 and 11 in which the tightening cable has been pulled so as to cause the drive gear to rotate in the tightening direction.
Figure 13:
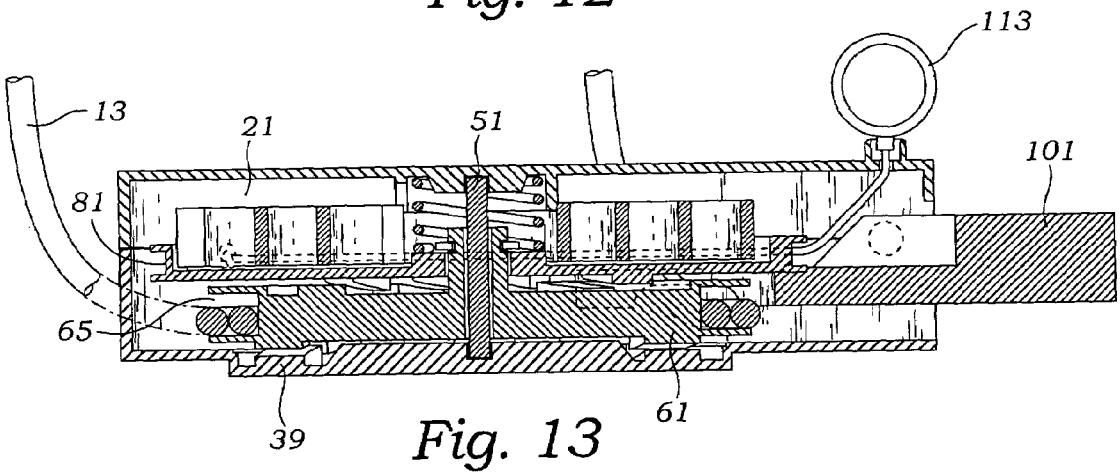
FIG. 13 is a side cut-away view illustrating the tightening mechanism shown in FIGS. 10, 11 and 12 illustrating the release of the tightening cable and its resulting withdrawal into the tightening mechanism's interior chamber.

In operation, once a person has inserted their foot into their tightening shoe 1, the person pulls a loop or tab 113 formed at the end of the tightening cable 111. As shown in FIGS. 11 and 12, withdrawal of the tightening cable through the housing's cable port 35 causes the drive gear 81 to rotate in the tightening direction 43. As a result of the drive gear ratcheting teeth 89 engaging the winding gear's second set of ratcheting teeth 69, the winding gear is also rotated causing the lace ends to rotate about the winding gear and withdraw the shoe laces into the tightening mechanism's interior chamber 21. Upon release of the tightening cable, the coil spring 95 biases the drive gear in the loosening direction. Meanwhile, the winding gear is prohibited from rotating in the loosening direction as a result of the winding gear's first set of ratcheting teeth engaging the housing's set of ratcheting teeth. Further pulling and subsequent release of the tightening cable continues to tighten the shoe's laces until the user reaches his or her desired comfort level.

Figure 14:
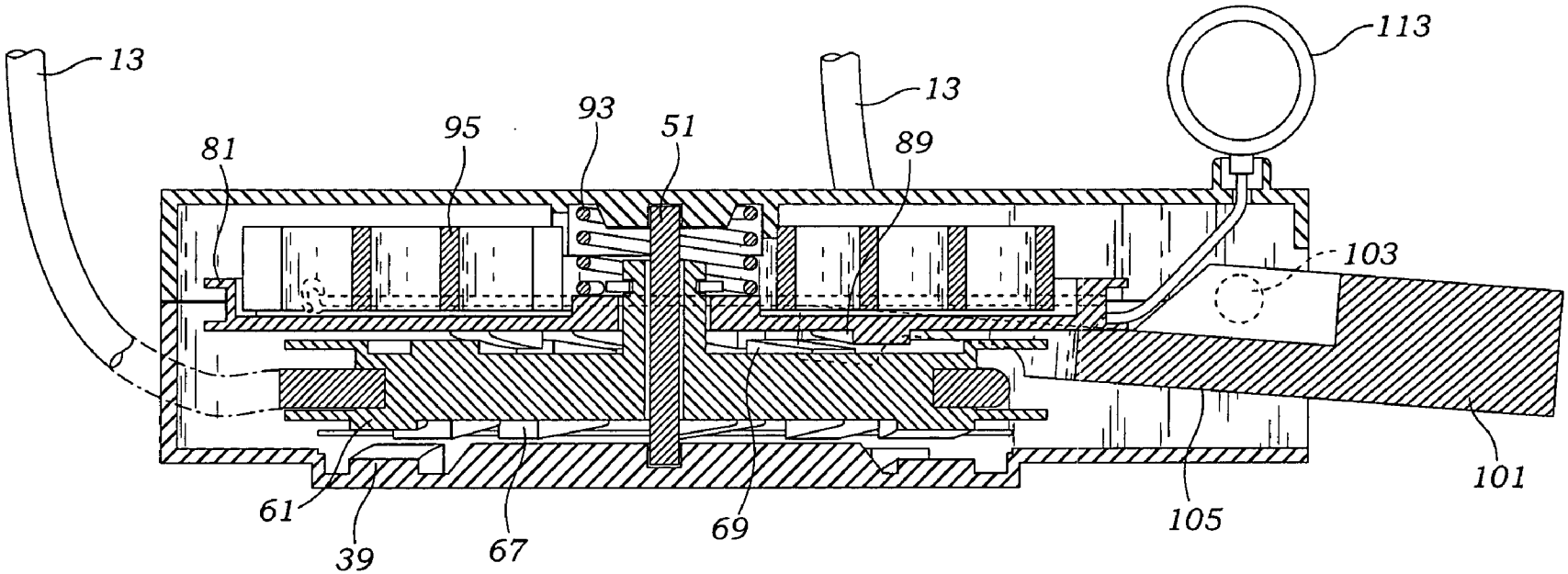
FIG. 14 is a side cut-away view illustrating the tightening mechanism shown in FIGS. 10-13 in which the lever arm has been depressed so as to cause disengagement of the drive gear, winding gear and housing, and the resulting loosening of the shoe laces.

To loosen the laces of the shoe, the user depresses the exterior portion of the lever arm 101. As shown in FIG. 14, depression of the lever arm causes the lever arm's fingers 105 to project upwardly, thereby causing both the drive gear 81, and subsequently the winding gear 61 to move upwardly within the tightening mechanism's housing until both pairs of ratcheting teeth disengage. Once disengaged, the winding gear can be spun freely, and the shoe laces can be withdrawn from within the tightening mechanism's interior chamber by a person simply pulling on the shoe laces upon the shoe's upper. Further tightening and loosening of the shoe can be accomplished in reverse manner.

While a preferred embodiment of the invention has been illustrated and described, it will be apparent to those skilled in the art that various modifications can be made without departing from the spirit and scope of the invention. For example, the Figures illustrate that the lace ports 23 are preferably configured 180 degrees from each other to facilitate uniform winding of the laces around the winding gear. However, as shown in FIG. 1, lace ports can be configured in any number of positions, such as by positioning both lace ports at the tightening mechanism's rear edge. The drive gear and winding gear may also be constructed in various configurations. For example, as described and shown herein, the drive gear and winding gear are preferably circular or cylindrical. Indeed, the inventor's preferred drive gear has a diameter of approximately 36 mm and a thickness of 6.5 mm, while the winding gear has a preferred outer diameter of 31 mm and a preferred thickness of 5.1 mm. However, various dimensions and even polygonal shapes can also be used to practice the present invention. Accordingly, it is not intended that the invention be limited except by the following Claims.

We claim:

1. A tightening and loosening shoe comprising:

(a) a shoe having a sole and an upper connected to said sole, the front and rear of said sole and said upper defining a heel and a toe;

(b) a housing located in said shoe, said housing including an interior chamber and having first and second ports for receiving lace ends into said chamber;

(c) one or more laces crisscrossing said upper, said laces including first and second ends with tension placed upon said lace ends causing said laces to tighten across said upper, said lace ends extending from exterior of said housing through said first and second ports into said interior chamber;

(d) a winding gear having a cylindrical body defining a perimeter with a set of teeth positioned on such winding gear body, and an axis of rotation about which said winding gear rotates, said winding gear body being rotatably positioned substantially horizontal within said housing so that said axis of rotation is substantially vertical, said first and second lace ends affixed to said perimeter of said winding gear so that rotation of said winding gear causes said lace ends to wind about the perimeter of said winding gear; and (e) a tightening gear with a set of teeth positioned thereon and in operative engagement with the winding gear teeth for causing said winding gear to rotatably advance in a tightening direction to wind said one or more laces about the perimeter of said winding gear and thus tighten said laces of said shoe.

2. The tightening and loosening shoe comprising:

(a) a shoe having a sole and an upper connected to said sole, the front and rear of said sole and said upper defining a heel and a toe;

(b) a housing located in said shoe, said housing including an interior chamber and having first and second ports for receiving lace ends into said chamber;

(c) one or more laces crisscrossing said upper, said laces including first and seconds ends with tension placed upon said lace ends causing said laces to tighten across said upper, said lace ends extending from exterior of said housing through said first and second ports into said interior chamber;

(d) a winding gear having a cylindrical body defining a perimeter with a set of teeth positioned on such winding gear body, and an axis of rotation about which said winding gear rotates, said winding gear body being rotatably positioned substantially horizontal within said housing so that said axis of rotation is substantially vertical, said first and second lace ends affixed to said perimeter of said winding gear so that rotation of said winding gear causes said lace ends to wind about the perimeter of said winding gear; and (e) a tightening means connected to said winding gear for causing said winding gear to rotatably advance in a tightening direction to wind said one or more laces about said winding gear and thus tighten said laces of said shoe, such tightening means comprising:

(i) a tightening cable extending from exterior of said housing through said third port into said interior chamber;

(ii) an axle positioned in said housing defining a first axis, rotation about said axle defining a first tightening direction and rotation about said axis in the opposite direction defining a second loosening direction;

(iii) said winding gear rotatably positioned to rotate about said first axis, said winding gear having first and second sides, said winding gear further having a first set of ratcheting winding gear teeth concentrically positioned on said first side of said winding gear, and a second set of ratcheting winding gear teeth concentrically positioned on said second side of said winding gear;

(iv) said lace ends affixed to the perimeter of said winding gear so that rotation of said winding gear in the tightening direction causes said lace ends to wind about said winding gear;

(v) a drive gear rotatably positioned to rotate about said first axis adjacent to said winding gear, said drive gear having first and second sides and a perimeter, said drive gear further having a set of ratcheting drive gear teeth concentrically positioned and aligned on said first side of said drive gear to engage said first set of winding gear teeth;

(vi) one or more locking ratcheting teeth positioned within said housing so as to engage said second set of winding gear teeth;

(vii) a biasing means for rotatably biasing said drive gear in said loosening direction;

(viii) said tightening cable affixed to and at least partially wound about the perimeter of said drive gear so that withdrawal of said tightening cable causes said drive gear to rotate in said tightening direction causing said drive gear teeth to engage said first set of winding gear teeth to cause the rotation of said winding gear in the tightening direction, and thus causing the lace ends to wind about the perimeter of said winding gear and the tightening of said laces of said shoe;

(ix) the release of said tensioning cable causing said biasing means to cause the drive gear to rotate in the loosening direction, and causing said second set of winding gear teeth to engage and lock to said locking teeth to prevent rotation of the winding gear in the loosening direction; and (x) disengagement means for selectively causing said drive gear teeth to disengage from said first set of winding gear teeth and causing said second set of winding gear teeth to disengage from said locking teeth so that tension upon said first and second laces causes said winding gear to rotate in the loosening direction to loosen said laces of said shoe.

3. The tightening and loosening shoe of claim 2 wherein:

(a) said drive gear and said winding gear are axially moveable along said first axis;

(b) said disengagement means includes an axially biasing means for biasing said drive gear against said winding gear and for biasing said winding gear against said locking teeth, and a lever arm projecting from exterior of said shoe into said housing; and (c) said lever arm operable upon depression to force said drive gear away from said winding gear and for forcing said winding gear away from said locking teeth to cause said drive gear teeth to disengage from said first set of winding gear teeth, and cause said second set of winding gear teeth to disengage from said locking teeth so that tension upon said first and second laces causes said winding gear to rotate in the loosening direction to loosen said laces of said shoe.

4. A tightening and loosening shoe comprising:

(a) a shoe having a sole and an upper connected to said sole, the front and rear of said sole and said upper defining a heel and a toe;

(b) a housing located in said shoe, said housing including an interior chamber and having first and second ports for receiving lace ends into said chamber and a third port for receiving a tightening cable into said chamber;

(c) one or more laces crisscrossing said upper, said laces including first and second ends with tension placed upon said lace ends causing said laces to tighten across said upper, said lace ends extending from exterior of said housing through said first and second ports into said interior chamber;

(d) a tightening cable extending from exterior of said housing through said third port into said interior chamber;

(e) an axle positioned within said housing defining a first axis, rotation about said axle defining a first tightening direction, and rotation about said axis in the opposite direction defining a second loosening direction;

(f) a winding gear rotatably positioned within said housing to rotate about said first axis, said winding gear having a body defining first and second sides and a perimeter, said winding gear further having a first set of ratcheting winding gear teeth concentrically positioned on said first side of said winding gear and a second set of ratcheting winding gear teeth concentrically positioned on said second side of winding gear;

(g) said lace ends affixed to the perimeter of said winding gear so that rotation of said winding gear in the tightening direction causes said lace ends to wind about said winding gear;

(h) a drive gear rotatably positioned within said housing to rotate about said first axis adjacent to said winding gear, said drive gear having first and second sides and a perimeter, said drive gear further having a set of ratcheting drive gear teeth concentrically positioned and aligned on said first side of said drive gear to engage said first set of winding gear teeth;

(i) one or more locking ratcheting teeth positioned within said housing so as to engage said second set of winding gear teeth;

(j) a biasing means for rotatably biasing said drive gear in said loosening direction;

(k) said tightening cable affixed to and at least partially wound about the perimeter of said drive gear so that withdrawal of said tightening cable through said third port causes said drive gear to rotate in said tightening direction causing said drive gear teeth to engage said first set of winding gear teeth to cause the rotation of said winding gear in the tightening direction, and thus causing the lace ends to wind about the perimeter of said winding gear and the tightening of said shoe;

(l) the release of said tensioning cable causing said biasing means to cause the drive gear to rotate in the loosening direction and causing said second set of winding gear teeth to engage and lock to said locking teeth to prevent rotation of the winding gear in the loosening direction; and (m) disengagement means for selectively causing said drive gear teeth to disengage from said first set of winding gear teeth, and causing said second set of winding gear teeth to disengage from said locking teeth so that tension upon said first and second laces causes said winding gear to rotate in the loosening direction to loosen said laces of said shoe.

5. The tightening and loosening shoe of claim 4 wherein:

(a) said drive gear and said winding gear are axially moveable along said first axis;

(b) said disengagement means includes an axially biasing means for biasing said drive gear against said winding gear and for biasing said winding gear against said locking teeth, and a lever arm projecting from exterior of said shoe into said housing;

(c) said lever arm operable upon depression to force said drive gear away from said winding gear and for forcing said winding gear away from said locking teeth to cause said drive gear teeth to disengage from said first set of winding gear teeth, and cause said second set of winding gear teeth to disengage from said locking teeth so that tension upon said first and second laces causes said winding gear to rotate in the loosening direction to loosen said laces of said shoe.

6. The tightening and loosening shoe of claim 4, wherein said winding gear body is positioned substantially horizontal within said housing so that said axis of rotation is substantially vertical.

* * * * *